US005190189A

United States Patent [19]

Zimmer et al.

[11] Patent Number: 5,190,189

[45] Date of Patent: Mar. 2, 1993

[54] LOW HEIGHT BEVERAGE DISPENSING APPARATUS

[75] Inventors: Elvis S. Zimmer, Princeton; Douglas Goulet, Big Lake, both of Minn.

[73] Assignee: IMI Cornelius Inc., Anoka, Minn.

[21] Appl. No.: 605,709

[22] Filed: Oct. 30, 1990

[51] Int. Cl.[5] ..... B67D 5/08

[52] U.S. Cl. ..... 222/67; 222/146.6; 261/27; 261/DIG. 7

[58] Field of Search ..... 222/67, 129.1, 146.6; 62/392, 389, 394, 429; 261/DIG. 7, 27

[56] References Cited

U.S. PATENT DOCUMENTS

| | | | |
|---|---|---|---|
| 2,291,826 | 8/1942 | Muffly | 62/429 |
| 2,734,357 | 2/1956 | Fischer et al. | 62/392 |
| 3,266,672 | 8/1966 | Dean | 222/129.1 |
| 3,416,329 | 12/1968 | Thomas | 62/429 |
| 3,721,369 | 3/1973 | Conti et al. | 222/67 |
| 3,731,845 | 5/1973 | Booth | 222/129.1 |
| 4,440,318 | 4/1984 | Berger | 222/129.1 |
| 4,493,441 | 1/1985 | Sedam et al. | 222/146.6 |
| 4,745,853 | 5/1988 | Hoover | 261/27 |
| 4,804,112 | 2/1989 | Jeans | 222/129.1 |
| 4,917,831 | 4/1990 | Ziesel et al. | 261/DIG. 7 |

FOREIGN PATENT DOCUMENTS

| | | | |
|---|---|---|---|
| 406297 | 9/1970 | Australia | 222/146.6 |

*Primary Examiner*—Andres Kashnikow
*Assistant Examiner*—Philippe Derakshani
*Attorney, Agent, or Firm*—Sten Erik Hakanson

[57] ABSTRACT

The present invention is a beverage dispenser having a low overall vertical height profile. The dispenser includes a water bath tank. The tank volume is enclosed along a top surface thereof by a support plate. A condenser extends horizontally with and adjacent to a top surface of the support plate. A motor is secured to the top plate and includes a shaft with a blade on one end thereof for agitating the water held within the water bath, and includes a condenser cooling fan on the opposite end of the shaft thereof for cooling the condenser. An evaporator is located in the tank horizontally with and closely adjacent to the tank bottom surface. An elongate carbonator extends lengthwise in a substantially horizontal manner in the tank and is located therein between the support plate and the evaporator. In one embodiment, the level of water within the carbonator is regulated by the buoyancy level of the carbonator in the tank.

23 Claims, 6 Drawing Sheets

1
9
10
85b
85a
84
22
80
78
86
68
58
70
17
3
4
25a
16a
54
56
38
44
34
62
36
24
25
20
32
15
5
8
30
44
3
25a
16
92
38
14
18
12
6
7
3

LOW HEIGHT BEVERAGE DISPENSING APPARATUS

FIELD OF THE INVENTION

The present invention relates generally to beverage dispensing apparatus and, more particularly, to such apparatus having an ice bank and internal carbonator.

BACKGROUND OF THE INVENTION

Beverage dispensers generally include a carbonator for carbonating a source of potable water and often utilize an ice bank refrigeration system for cooling thereof. Such cooling is accomplished through the use of an evaporator having an ice-bank therearound and submerged within a water for heat exchange cooling of the carbonated water and beverage syrups as they are piped through the water bath to a dispensing valve. As is known in the art, an ice bank provides a means for building up a large cooling capacity during periods of relative non-use. In this manner, smaller, less costly, refrigeration components can be used. Further savings in space can be had if the carbonator is held internally of the water tank containing the ice bank.

However, additional reductions in size and cost are continually demanded of beverage dispensing equipment. Accordingly, it would be desirable to have a beverage dispensing machine that is compact and low in cost.

SUMMARY OF THE INVENTION

The present invention concerns a beverage dispensing apparatus of the ice bank type. A water tank for holding the ice bank has a bottom end and a top support cover and perimeter walls extending vertically therebetween. A compressor, water pump and electric motor are secured to the support cover. The electric motor has a shaft extending downwardly therefrom into the tank and terminating with an agitator blade for agitating the water held therein. The opposite end of the shaft includes a condenser fan thereon. A condenser is mounted horizontally and substantially parallel to the top cover and closely adjacent the condenser fan. An evaporator, or ice bank forming coil, is mounted horizontally within the tank and adjacent to the bottom end thereof. A cylindrical carbonator extends lengthwise at a small angle from that of horizontal within the tank volume between the tank and the evaporator. The carbonator is provided with means for sensing the level of water therein. In addition, a source of carbon dioxide is connected to the carbonator tank and a carbonated water outlet from the carbonator tank is connected to a plurality of beverage dispensing valves for ultimate dispensing of the carbonated water therefrom.

It can be appreciated by those of skill that the general horizontal orientation of the carbonator tank is facilitated by the horizontal orientation adjacent the bottom of the tank of the evaporator which, in combination with a horizontally extending condenser, provides for an ice bank container tank having a lower overall vertical height. Thus, the present invention is useable in a wider range of countertop locations wherein overhead space is limited.

DESCRIPTION OF THE FIGURES

Further features and advantages of the present invention will become evident in light of the following detailed description, which description refers to the following drawings, wherein.

DETAILED DESCRIPTION

Figure 1:
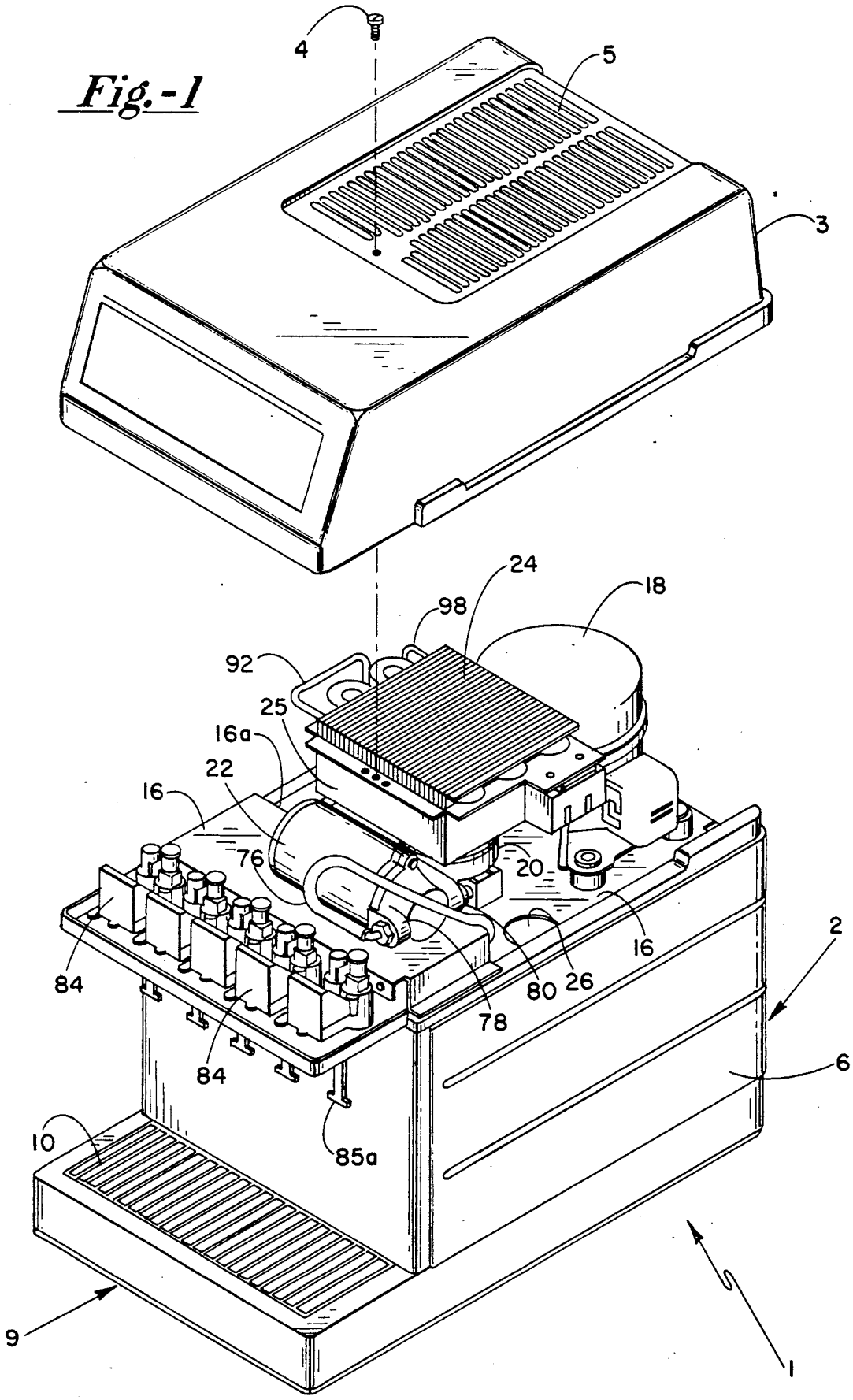
FIG. 1 shows a perspective view of the present invention.
Figure 2:
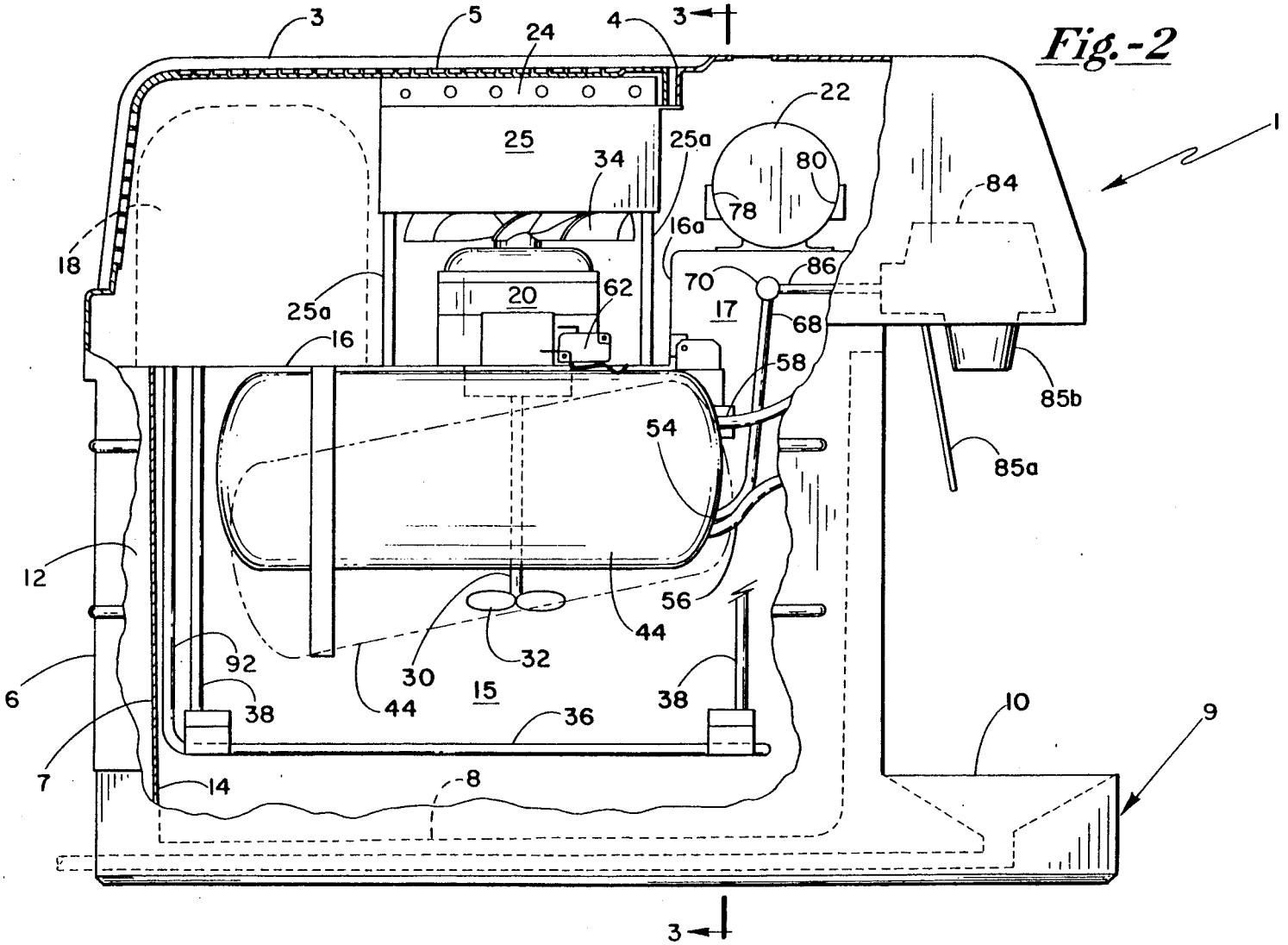
FIG. 2 is a side plan view of the present invention having a portion cut away.

Referring to the various figures, the beverage dispensing apparatus of the present invention is generally designated 1. As seen in FIGS. 1–4, dispenser 1 includes a lower housing portion 2 and a top cover 3. Cover 3 is releaseably secured to dispenser 1 by a screw 4 and includes a louvered portion 5. Housing 2 is preferably a rotomolded plastic unit having exterior walls 6, and interior side walls 7, and bottom end 8. A beverage drain portion 9 includes a cup or receptacle rest 10. Walls 6, 7 and 8 define an interior insulation containing space 12. Walls 7 and bottom surface 8 serve to define an interior water bath tank 14 having a volume 15. A rigid support cover plate 16 is secured on top of and around the perimeter of tank 14, and includes a vertical portion 16*a* for creating a clearance space 17. Cover 16 is preferably made from a non-corrosive metal of sufficient strength to support various components thereon and serve to enclose tank volume 15. In particular, the components secured to cover 16 include a refrigeration compressor 18, an electric motor 20, and a water pump 22. In addition, a condenser 24 extends horizontally above cover 16 and is secured to an air directing housing 25. Housing 25 is secured to cover 16 by four support legs 25*a*. A plug 26 extends through cover 16 and provides for access into tank 14 for filling volume 15 with water. It will be understood that tank 14 is desirably maintained substantially filled with water.

Motor 20 includes a shaft 30 extending into volume 15 and terminating with a agitator blade 32 secured thereto. Shaft 30 also includes a condenser cooling fan 34 secured to the opposite end thereof and held adjacent condenser 24.

An evaporator or ice bank forming cooling coil 36 is suspended within volume 14 and extends substantially through a horizontal plane adjacent bottom end surface 8. Coil 36 is suspended from cover 16 and secured thereto by a plurality of rods 38 extending therebetween. An ice bank 40 forms around coils 36, the size of which is regulated by an ice bank sensing means 42 secured to the individual coils of evaporator 36.

Figure 3:
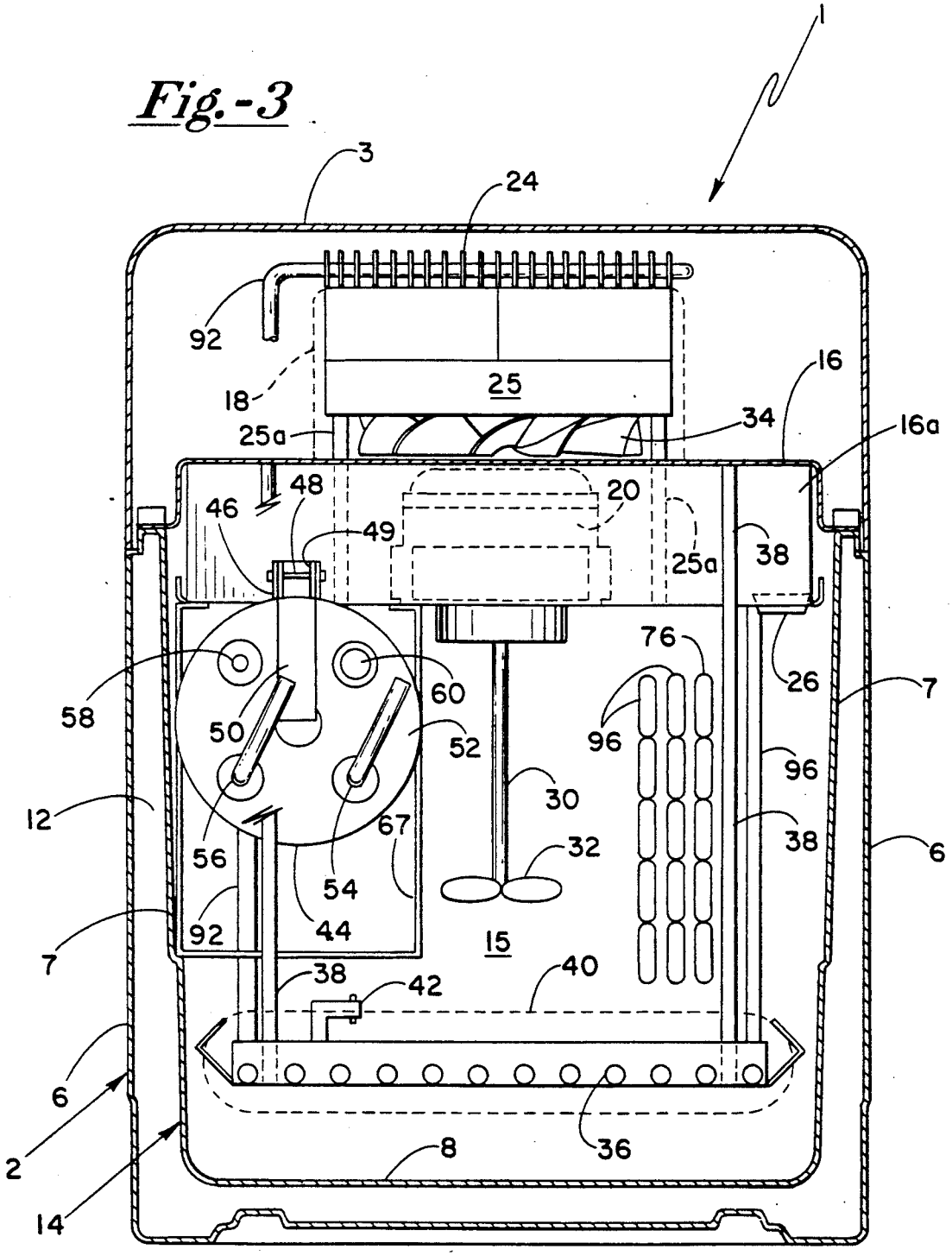
FIG. 3 shows an end partial cross-sectional view of the present invention along lines 3—3 of FIG. 2.
Figure 4:
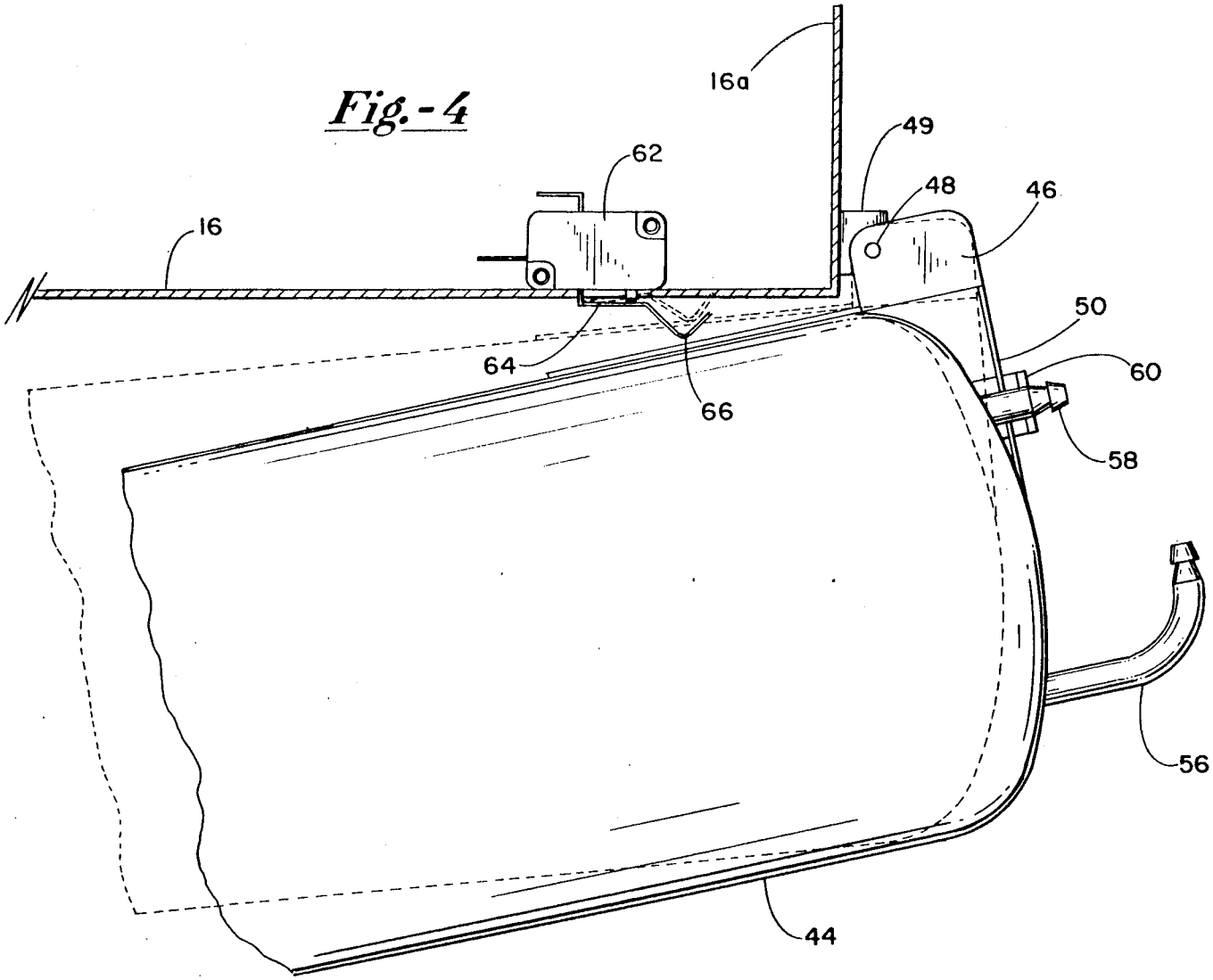
FIG. 4 shows an enlarged view of carbonator fill switch and pivot attachment of the carbonator.

A cylindrical elongate carbonator 44 is held within volume 15 and, thus, suspended in the water held therein. Carbonator 44 is pivotally secured on one end thereof to cover 16 by a bracket 46 pivotally secured to cover 16 by a pin 48 extending between vertical tabs 49 integral with cover 16 and extending outwardly therefrom. Bracket 46 includes a flange 50 integral therewith and extending therefrom and secured to a front end 52 of carbonator 44. As seen in FIG. 3, front end 52 of carbonator 44 includes a carbonated water outlet 54, a carbon dioxide gas inlet 56, a water inlet 58, and a safety pressure release valve 60. A pair of pump control switches 62 connected in series are secured to the top surface of cover 16 and include spring biased actuating arms 64 extending therefrom and terminating with downwardly pointed contact ends 66 for contacting the exterior surface of carbonator 44. A carbonator travel limiting or constraining bracket 67 is secured to cover 16 and depends therefrom within volume 15.

Figure 5:
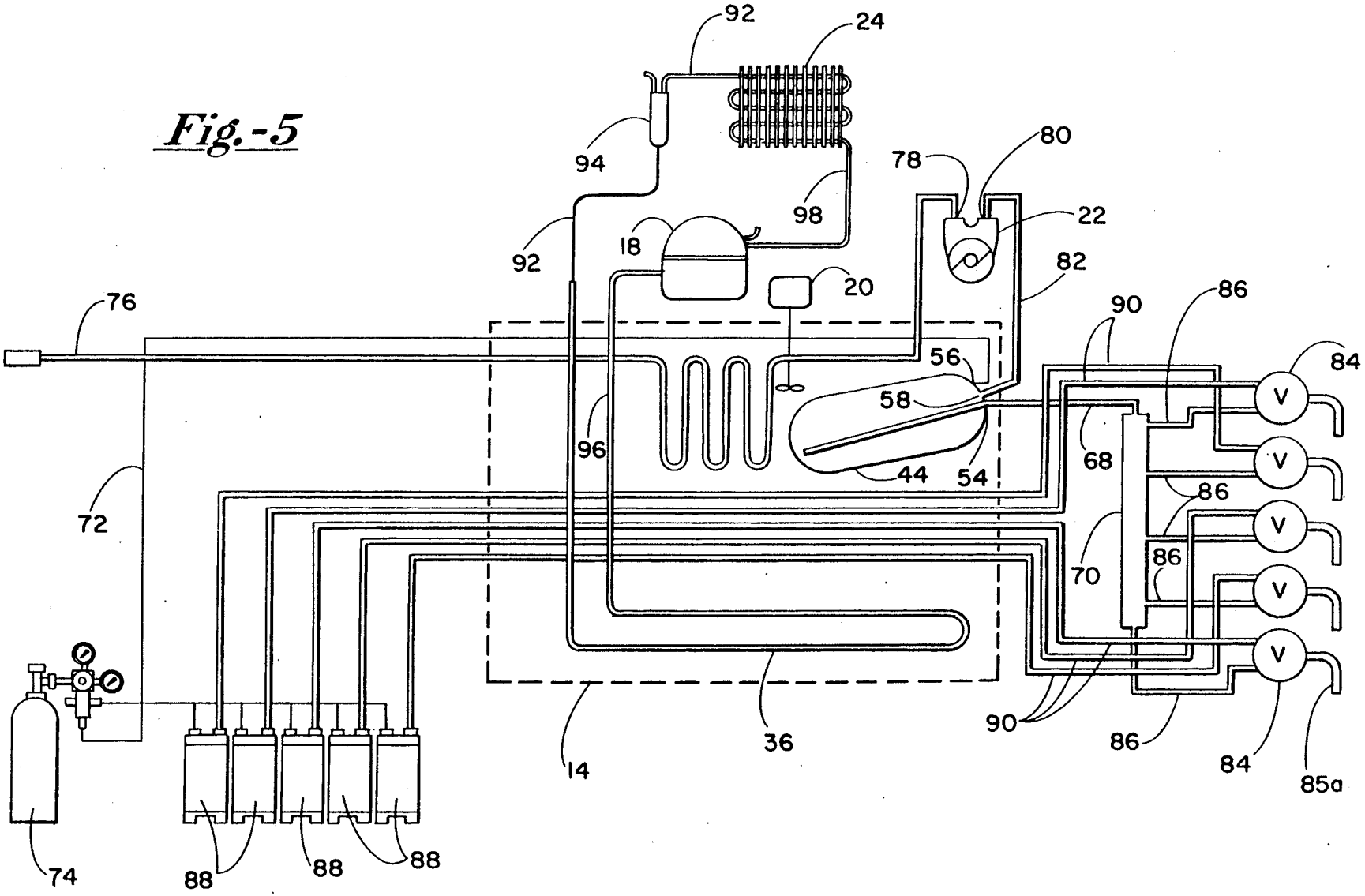
FIG. 5 shows a schematic representation of the fluid, gas and refrigerant connections of the present invention.

A better understanding of the fluid and refrigeration connections of dispenser 10 can be had by also referring to the schematic diagram of FIG. 5. A carbonated water delivery hose 68 provides fluid communication from outlet 54 to a carbonated water manifold 70. Carbon dioxide inlet 56 is connected by a hose 72 to a regulated source of pressurized carbon dioxide 74. Water is supplied to pump 22 by a water line 76 connected to a source of potable water (not shown). Line 76 extends through volume 15 and is connected to an inlet 78 of pump 22. An outlet 80 of pump 22 is, in turn, connected by a hose 82 to the water inlet 58. It will be understood by those of skill, that water line 76 preferably consists of a metal coil extending in a serpentine fashion and held within volume 15 and of sufficient length to provide for adequate cooling of the water prior to its introduction in carbonator 44. A plurality of beverage dispensing valves 84 are secured to cover 16 and include actuating levers **85*a* and nozzles 85*b* and include carbonated water inlets (not shown). Hoses 86 are connected to the carbonated water inlets of valves 84 and to manifold 70 to provide for fluid communication therebetween. Each valve 84 is connected to a unique source of syrup held within containers 88 and delivered thereto by hoses 90. Hoses 90 are preferably made of a flexible material such as polyethylene and are held within interior ice bank volume 14 for cooling of the syrup as it passes therethrough to valves 84. As is known in the art, lines 90 can extend in a serpentine fashion within volume 14** to allow for sufficient length therein to provide for adequate cooling of a desired volume of syrup.

As seen in FIG. 5, the various refrigeration line connections are shown and, as is known in the art, include a refrigerant line 92 extending from condenser 24 to expansion valve 94 and therefrom to coil 36. Expansion valve 94 provides for a regulated supply of refrigerant to coil 36. A return line 96 extends from coil 36 to the low side or inlet of compressor 18. A line 98 supplies refrigerant from compressor 18 to condenser 24.

Figure 6:
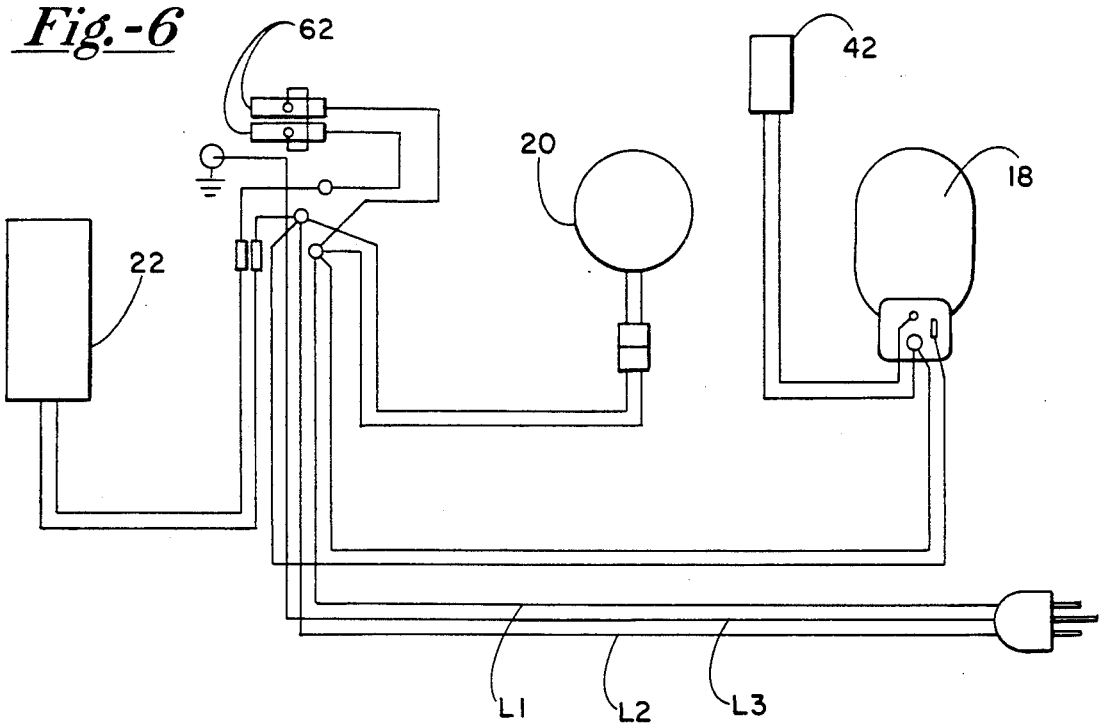
FIG. 6 shows an electrical schematic of certain major components of the present invention.

Referring to FIG. 6, it can be seen that power is supplied by lines L1 and L2 directly to motor 20. A line L3 provides for safety grounding of dispenser 10. Ice bank control 42 provides for regulating the operation of compressor 18. Water pump 22 is controlled by the operation of switches 62. Thus, as is understood by reference to FIG. 6, motor 20 will run continuously when power is supplied thereto, whereas the operation of compressor 18 is regulated by the need, or lack of need, for the information of ice on the ice bank 40 as determined by sensor 42, and operation of pump 22, hence, the filling of carbonator 44 with water is regulated by the operation of switches 62. Switches 62 are connected in series to provide for a safety margin or redundancy. Thus, should one switch fuse, the other would disconnect and prevent overfilling of the carbonator.

In operation, it can be understood that the refrigeration means, including compressor 18, condenser 24, and evaporator coil 36 provide for cooling of the water held within volume 15. Specifically, over time an ice bank 40 is formed around coil 36, the size thereof being regulated by ice bank sensing means 42. It can be appreciated that motor 20 provides both for the agitation of water held within volume 15 by the operation of blade 32 and for the cooling of refrigerant within condenser 24 by the operation of fan 34. Carbonated water is produced by carbon dioxide delivered to carbonator 44 through inlet 56 and combined with water delivered thereto through water inlet 58 by the operation of pump 22. Carbon dioxide is provided at sufficient pressure such that the water held within carbonator 44 becomes sufficiently carbonated. Carbonated water is then supplied to manifold 70 and, in turn, separately to the valves 84. Thus, as is a known in the art, operation of an actuating arm **85*b* of a valve 84 provides for simultaneous mixing of carbonated water and the particular syrup for producing the beverage which is dispensed through the respective nozzle 85*a* into a suitable receptacle. Rest 10 provides support for such a receptacle and any spilling or dripping of beverage falls therethrough into drain 9 and is directed thereby to a suitable waste receptacle or drain exterior of dispenser 1. It can be appreciated that lines 76 and 90 allow for heat exchange between the water held in volume 15 and the water being delivered to pump 22 and the syrup delivered to each of the valves, respectively, Also, it can be understood that vertical portion clearance space 17 allows room for facilitating the various fluid connection between pump 22, carbonator 44, manifold 70 and valves 84**.

The pivotal mounting of carbonator 44 to cover 16, in combination with the actuation of switches 62 provide for an inexpensive and automatic regulating of the filling of carbonator 44 with water. As is understood in the art, as beverage is dispensed, the carbonated water held within carbonator 44 is eventually depleted. In the present invention, as the volume of water in carbonator 44 decreases, carbonator 44 becomes lighter and, therefore, more buoyant in the water held within container volume 15. As a result thereof, carbonator 44 floats upwardly towards cover 16. As this upward movement occurs, the upper surface of carbonator 44 comes into contact with ends 66 of switch arms 64 as carbonator 44 pivots about pin 48. Pump 22 is then turned on when carbonator 44 reaches a top buoyant level filling position, as indicated by the solid lines thereof, and operates to fill carbonator 44 with water. As a result thereof, carbonator 44 becomes less buoyant and moves downwardly away from cover 16, to a bottom position as indicated by the dashed line representation thereof. Such low position being limited by bracket 67. Also, bracket 67 serves to prevent any lateral movement of carbonator 44, that is, to restrain carbonator 44 to substantially vertical up and down movement to insure positive contact with switches 62. When carbonator 44 moves downwardly, it can be understood that switch arms 64 are then free to swing downwardly in a similar direction, turning off switch 62, hence stopping the operating of pump 22. It will be understood that switch 62 has an action wherein pump 22 is not turned off until carbonator 44 reaches the bottom position whereby a buffer volume is created between the carbonator high and low positions. It can be appreciated that hoses 68, 72 and 82 are made of a flexible material to allow for the up and down movement of carbonator 44. As is understood by those of skill, such hoses are clamped, or otherwise secured, to the various outlet and inlet fittings of carbonator 44, manifold 70 and pump 22. This invention, therefore, provides for a highly reliable and inexpensive means for regulating the volume of water contained within a carbonator.

Figure 7:
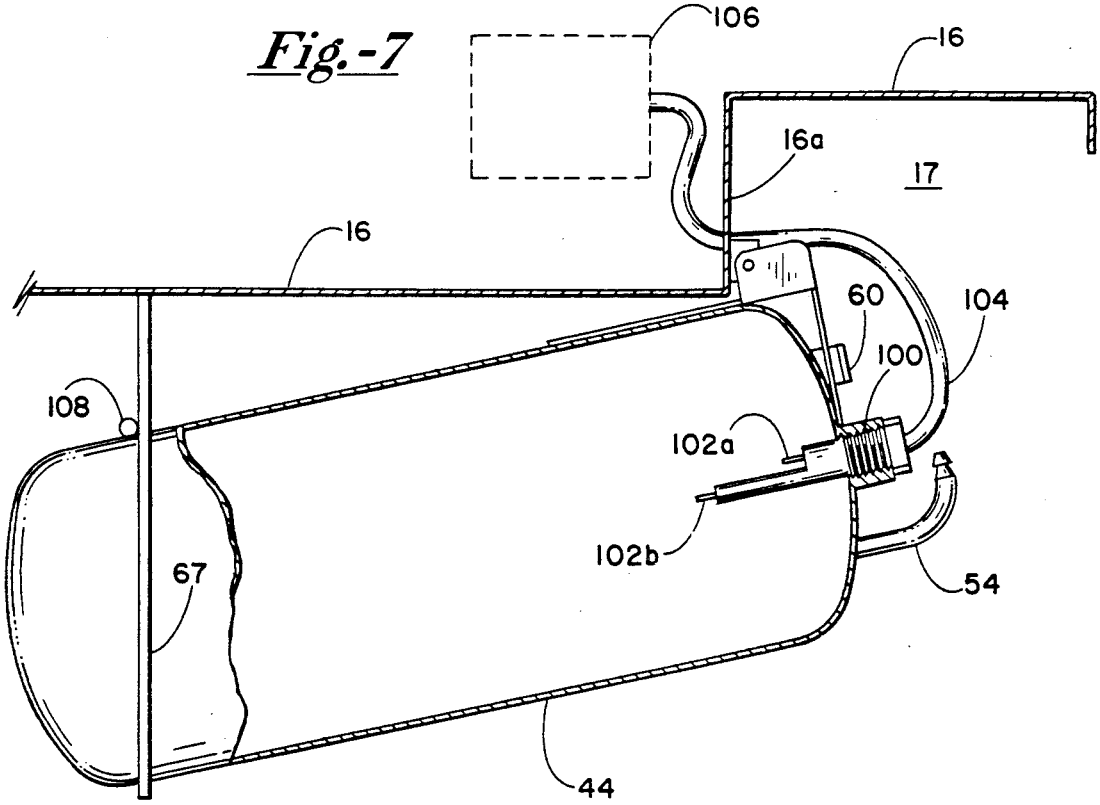
FIG. 7 shows a side plan partial cross-sectional view of the carbonator showing a further embodiment of the present invention.

In a further embodiment of the present invention, as seen by referring to FIG. 7, carbonator 44 is adapted to function using, as is known in the art, electronic water level sensing means. A probe 100 extends within carbonator 44 and has a pair of contact ends 102*a* and 102*b*. Probe 100 is connected by a wiring 104 to an electronic control circuit 106. Any flotation movement of carbonator 44 is prevented by a cross bracket 108 secured to bracket 67. Thus, carbonator 44 is maintained at a shallow angle with respect to support cover 16. In operation, as is known in the art, when the water level within carbonator 44 goes below probe 102*b*, the electronic control signals the operation of pump 22 to replenish carbonator 44 with water. When teh water level within carbonator 44 reaches probe 102*a*, the electronic control stops the operating of pump 22. Thus, pump 22 is not signaled to add water to carbonator 44 at the instant the water level therein goes below probe 102*a*, but rather is not activated until the water level in carbonator 44 goes below probe 102*b*. Thus, the vertical height difference between the probes 102*a* and 102*b* serves basically to create the volume range within which pump 22 is not operated. However, this volume range can be increased by positioning carbonator 44 at an angle with respect to the horizontal, as seen in FIG. 7. It will also be understood that probe 100 could be of many different configurations and secured to and within a carbonator in a variety of ways to provide for a non pump operating volume range. For example, as seen in ghost outline in FIG. 7, carbonator 44 could be fixed in a horizontal position and probe 100 could extend therein in a vertical direction.

It can also be seen that the horizontal extension of evaporator coil 36, and condenser 24, and the substantially horizontal extension of carbonator 44 provide for a reduced total vertical profile of dispenser 1. Moreover, the location of evaporator 36 adjacent bottom 15 of volume 14 greatly facilitates the pivotal securing orientation of carbonator 44 to cover 16, as opposed to conventional evaporator positioning around the perimeter or centrally of an ice bank tank volume. In addition, it can be understood that the securing of elongate cylindrical carbonator 44 in the water bath so that carbonator 44 extends in a lengthwise manner is substantially horizontal orientation serves to minimize the vertical height needed for the holding thereof within the water bath. Thus, the present invention has a substantially reduced overall vertical height. In addition, the use of a buoyancy approach to carbonator water level sensing provides for a low cost and reliable means for accomplishing such sensing.

We claim:

1. A carbonated beverage dispenser, comprising:

a cooling tank having a bottom end surface and perimeter walls extending upwardly therefrom to a top end defining a tank interior volume for holding a volume of water therein, and a rigid support cover extending over the tip end the support cover having a top surface, and a bottom surface facing the tank interior volume, a drive motor secured to the cover top surface and including a drive shaft, the drive shaft having an upwardly extending portion having a cooling fan thereon, refrigeration means including a condenser and an evaporator, the condenser extending substantially horizontally with the support cover top surface and positioned adjacent to and above the cooling fan, and the evaporator held in the tank and extending substantially parallel with and adjacent the bottom end surface of the cooling tank for cooling the water therein, an elongate carbonator secured within the cooling tank and extending substantially horizontally therein between the cover and the tank bottom surface, and means for maintaining a volume of carbonated water in the carbonator within a desired volume range.

2. The dispenser as defined in claim 1, and the drive motor drive shaft having a portion extending downwardly into the tank volume and having an agitating blade thereon, the agitating blade held within the volume of water for providing movement thereof within the tank volume.

3. The dispenser as defined in claim 1, and the means for maintaining a volume of carbonated water in the carbonator comprising a level sensing probe within the carbonator for sensing the level of water in the carbonator and the probe connected to electrical control circuit means for operating a water pump fluidly connected to the carbonator for pumping water therein from a water source in response to the sensed water level for maintaining a desired volume of water in the carbonator.

4. The dispenser as defined in claim 3, and the probe having a high water level sensing portion and a low water level sensing portion.

5. A carbonated beverage dispenser, comprising:

a cooling tank having a bottom end surface and perimeter walls extending upwardly therefrom to a top end defining a tank having an interior volume for holding a volume of water therein, and a rigid support cover extending over the top end the support cover having a top surface, and a bottom surface facing the tank interior volume, refrigeration means including a condenser and an evaporator, the condenser extending substantially horizontally with and secured adjacent to the support cover top surface and the evaporator held in the tank and extending substantially horizontally with and adjacent to the bottom end surface of the cooling tank for cooling the water therein, water pump means connected to a source of water and operable for providing a pressurized flow of water from the water source, a carbonator pivotally secured on one end thereof within the cooling tank and extending lengthwise therein between the evaporator and the cover the carbonator having a gas inlet for connecting to a pressurized source of carbon dioxide, a water inlet connected to the pump means for permitting filling of the carbonator with water by operating of the pump means and a carbonated water outlet connected to a dispensing valve, and control means for operating the pump means for pumping water into the carbonator when the water therein goes below a desired low level and for turning off the operating of the pump means when the water level in the carbonator reaches a desired high level, and the control means including switch means secured to the support cover and the switch means responsive to movement of the carbonator to a first position for turning on the pump means for filling the carbonator and the switch means responsive to movement of the carbonator to a second position for turning off the pump means when the carbonator reaches the second position.

6. The dispenser as defined in claim 5, and the control means including a level sensing probe within the carbonator and the probe connected to electrical control circuit means for operating the pump means in response to the level of water in the carbonator as sensed by the probe.

7. The dispenser as defined in claim 5, and further including a drive motor secured to the cover top surface and including a drive shaft, the drive shaft having an upwardly extending portion having a cooling fan thereon, the cooling fan held adjacent the condenser for providing cooling thereof.

8. The dispenser as defined in claim 7, and the drive motor drive shaft having a portion extending downwardly into the tank volume and having an agitating blade thereon, the agitating blade held within the volume of water for providing movement thereof within the tank volume.

9. A carbonated beverage dispenser comprising:

a cooling tank having a bottom end surface and perimeter walls extending upwardly therefrom to a top end defining a tank having an interior volume for holding a volume of water therein, and a rigid support cover extending over the top end the support cover having a top surface, and a bottom surface the tank interior volume, refrigeration means including a condenser and an evaporator, the condenser extending substantially horizontally with and secured adjacent to the support cover top surface and the evaporator extending substantially horizontally with and adjacent to the bottom end for cooling the water therein, water pump means connected to a source of water and operable for providing a pressurized flow of water from the water source, a carbonator pivotally secured on one end thereof within the cooling tank for permitting floating support thereof by the water therein and the carbonator secured therein so that the carbonator is allowed to float in the water between a top buoyancy water filling level and a bottom minimum buoyancy level, the carbonator having a gas inlet for connecting to a pressurized source of carbon dioxide, a water inlet connected to the pump means for permitting filling of the carbonator with water by operating of the pump means and a carbonated water outlet connected to a dispensing valve, and control means for maintaining a volume of water in the carbonator within a desired volume range, the control means including switch means secured to the support cover and the switch means responsive to movement of the carbonator for turning on the pump means when the carbonator reaches the top buoyancy position and the switch means for turning off the pump means when the carbonator reaches the minimum buoyancy position.

10. The dispenser as defined in claim 9, and further including a drive motor secured to the cover top surface and including a drive shaft, the drive shaft having an upwardly extending portion having a cooling fan thereon, the cooling fan held adjacent the condenser for providing cooling thereof.

11. The dispenser as defined in claim 10, and the drive motor drive shaft having a portion extending downwardly into the tank volume and having an agitating blade thereon, the agitating blade held within the volume of water for providing movement thereof within the tank volume.

12. A carbonated beverage dispenser, comprising:

a cooling tank having a bottom end surface and perimeter walls extending upwardly therefrom to a top end defining a tank having an interior volume for holding a volume of water therein, and a rigid support cover extending over the top end the support cover having a top surface, and a bottom surface facing the tank interior volume, refrigeration means including a condenser and an evaporator, the condenser extending substantially horizontally with and secured adjacent to the support cover top surface and the evaporator extending substantially horizontally with and adjacent to the bottom end for cooling the water therein, water pump means connected to a source of water and operable for providing a pressurized flow of water from the water source, a carbonator pivotally secured on one end thereof to the top cover and within the cooling tank for permitting floating support thereof by the water therein so that the carbonator is allowed to float in the water between a top buoyancy water filling level and a bottom minimum buoyancy level, the carbonator having a gas inlet for connecting to a pressurized source of carbon dioxide, a water inlet connected to the pump means for permitting filling of the carbonator with water by operating of the pump means and a carbonated water outlet connected to a dispensing valve, and control means for maintaining a volume of water in the carbonator within a desired volume range, the control means including switch means secured to the support cover and the switch means responsive to movement of the carbonator for turning on the pump means when the carbonator reaches the top buoyancy position and the switch means for turning off the pump means when the carbonator reaches the minimum buoyancy position.

13. The dispenser as defined in claim 12, and further including a drive motor secured to the cover top surface and including a drive shaft, the drive shaft having an upwardly extending portion having a cooling fan thereon, the cooling fan held adjacent the condenser for providing cooling thereof.

14. The dispenser as defined in claim 13, and the drive motor drive shaft having a portion extending downwardly into the tank volume and having an agitating blade thereon, the agitating blade held within the volume of water for providing movement thereof within the tank volume.

15. A carbonated dispenser, comprising:

a cooling tank having a bottom end surface and perimeter walls extending upwardly therefrom to a top end defining a tank having an interior volume for holding a volume of water therein, and a rigid support cover extending over the top end the support cover having a top surface, and a bottom surface facing the tank interior volume, refrigeration means including a condenser and an evaporator, the condenser extending substantially horizontally with and secured adjacent to the support cover top surface and the evaporator held in the tank and extending substantially horizontally with and closely adjacent to the bottom end for cooling the water therein, an elongate carbonator secured within the tank and extending substantially horizontally therein between the cover and the evaporator, the carbonator having a gas inlet for connecting to a pressurized source of carbon dioxide, a water inlet connected to the pump means for permitting filling of the carbonator with water by operating of the pump means, and a carbonated water outlet connected to a dispensing valve, a level sensing probe means within the carbonator for sensing the level of water in the carbonator and the probe connected to electrical control circuit means for operating the pump means in response to the sensed water level for maintaining a desired volume of water in the carbonator.

16. The dispenser as defined in claim 15, and further including a drive motor secured to the cover top surface and including a drive shaft, the drive shaft having an upwardly extending portion having a cooling fan thereon, the cooling fan held adjacent the condenser for providing cooling thereof.

17. The dispenser as defined in claim 16, and the drive motor drive shaft having a portion extending downwardly into the tank volume and having an agitating blade thereon, the agitating blade held within the volume of water for providing movement thereof within the tank volume.

18. A carbonated beverage dispenser, comprising:

a cooling tank having a substantially horizontal bottom end surface and perimeter walls extending upwardly therefrom to a top end defining a tank having an interior volume for holding a volume of water therein, and a rigid support cover extending over the top end support cover having a top surface, and a bottom surface facing the tank interior volume, refrigeration means a condenser and an evaporator, the condenser extending substantially horizontally and secured adjacent the support cover top surface and the evaporator held in the tank and extending substantially horizontally and adjacent to the bottom end for cooling the water therein, an elongate carbonator pivotally secured within the tank on one end thereof and extending lengthwise between the cover and the evaporator, the carbonator having a gas inlet for connecting to a pressurized source of carbon dioxide, a water inlet connected to the pump means for permitting filling of the carbonator with water by operating of the pump means, and a carbonated water outlet connected to a dispensing valve, control means responsive to movement of the carbonator and connected to the pump means for controlling the operating thereof wherein the control means initiates the operating of the pump means for filling the carbonator with water when the carbonator moves to a water filling position and stops the operating of the pump means when the carbonator moves to a carbonator full position.

19. The dispenser as defined in claim 18, further including a drive motor secured to the cover top surface and including a drive shaft, the drive shaft having an upwardly extending portion having a cooling fan thereon, the cooling fan held adjacent the condenser for providing cooling thereof.

20. The dispenser as defined in claim 19, and the drive motor drive shaft having a portion extending downwardly into the tank volume and having an agitating blade thereon, the agitating blade held within the volume of water for providing movement thereof within the tank volume.

21. A carbonated beverage dispenser, comprising:

a cooling tank having a substantially horizontal bottom end surface and perimeter walls extending upwardly therefrom to a top end defining a tank having an interior volume for holding a volume of water therein, and a rigid support cover extending over the top end the support cover having a top surface, and a bottom surface facing the tank interior volume, refrigeration means including a condenser and an evaporator, the condenser extending substantially horizontally and secured adjacent the support cover top surface and the evaporator held in the tank and extending substantially horizontally and adjacent to the bottom end for cooling the water therein, an elongate carbonator pivotally secured within the tank on one end thereof and extending lengthwise between the cover and the evaporator, the carbonator having a gas inlet for connecting to a pressurized source of carbon dioxide, a water inlet connected to the pump means for permitting filling of the carbonator with water by operating of the pump means and a carbonated water outlet connected to a dispensing valve, control means responsive to movement of the carbonator and connected to the pump means for controlling the operating thereof wherein the control means initiates the operating of the pump means for filling the carbonator with water when the carbonator moves to a water filling position and stops the operating of the pump means when the carbonator moves to a carbonator full position, and the control means including switch means secured to the support cover and the carbonator pivotally secured to the cover, and the switch responsive to movement of the carbonator towards a first position adjacent the support cover for turning on the pump means for filling the carbonator and the switch responsive to movement of the carbonator towards a second position below the support cover for turning off the pump means.

22. The dispenser as defined in claim 21, and further including a drive motor secured to the cover top surface and including a drive shaft, the drive shaft having an upwardly extending portion having a cooling fan thereon, the cooling fan held adjacent the condenser for providing cooling thereof.

23. The dispenser as defined in claim 22, and the drive motor drive shaft having a portion extending downwardly into the tank volume and having an agitating blade thereon, the agitating blade held within the volume of water for providing movement thereof within the tank volume.

* * * * *